US008210674B2

(12) United States Patent
Sugahara

(10) Patent No.: US 8,210,674 B2
(45) Date of Patent: Jul. 3, 2012

(54) LIQUID DROPLET JETTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 584 days.

(21) Appl. No.: 12/406,696

(22) Filed: Mar. 18, 2009

(65) Prior Publication Data

US 2009/0244240 A1 Oct. 1, 2009

(30) Foreign Application Priority Data

Mar. 31, 2008 (JP) ..... 2008-091651

(51) Int. Cl.
*B41J 2/01* (2006.01)

(52) U.S. Cl. ..... 347/104; 347/8; 347/16

(58) Field of Classification Search ..... 347/104, 347/8, 16, 37, 36, 33
See application file for complete search history.

(56) References Cited

U.S. PATENT DOCUMENTS

| | | | | |
|---|---|---|---|---|
| 5,646,653 | A * | 7/1997 | Fujioka et al. | 347/8 |
| 5,798,775 | A * | 8/1998 | Takahashi et al. | 347/33 |
| 5,859,653 | A * | 1/1999 | Aoki et al. | 347/8 |
| 6,474,566 | B1 * | 11/2002 | Hirota et al. | 239/102.2 |
| 6,585,350 | B2 * | 7/2003 | Barinaga | 347/33 |
| 7,090,419 | B2 | 8/2006 | Satoh et al. | |
| 7,484,829 | B2 * | 2/2009 | Sugahara | 347/45 |
| 7,562,975 | B2 * | 7/2009 | Yokoyama et al. | 347/104 |
| 7,784,891 | B2 * | 8/2010 | Kumagai | 347/8 |
| 2004/0160475 | A1 * | 8/2004 | Satoh et al. | 347/36 |
| 2004/0179062 | A1 | 9/2004 | Rai et al. | |
| 2005/0068365 | A1 * | 3/2005 | Takagi | 347/33 |
| 2007/0115318 | A1 * | 5/2007 | Nishizaki et al. | 347/33 |

FOREIGN PATENT DOCUMENTS

| | | | |
|---|---|---|---|
| JP | 2003-320673 | A | 11/2003 |
| JP | 2004-276374 | A | 10/2004 |
| JP | 2004-277023 | A | 10/2004 |
| JP | 2004-306578 | A | 11/2004 |
| JP | 2005-029333 | A | 2/2005 |
| JP | 2006-082344 | A | 3/2006 |
| JP | 2007-038558 | A | 2/2007 |
| JP | 2007-055107 | A | 3/2007 |
| JP | 2007-245549 | A | 9/2007 |

OTHER PUBLICATIONS

Japan Patent Office, Notice of Reasons for Rejection for Japanese Patent Application No. 2009-067492 (counterpart to above-captioned patent application), mailed Dec. 6, 2011.

* cited by examiner

*Primary Examiner* — Matthew Luu
*Assistant Examiner* — Henok Legesse
(74) *Attorney, Agent, or Firm* — Baker Botts L.L.P.

(57) ABSTRACT

An ink-jet printer has a line ink-jet head which includes a plurality of heat units arranged in two rows in a zigzag form along a main scanning direction, and a spur which is arranged to be in line in the main scanning direction, with a first head unit belonging to one row, and to overlap a second head unit adjacent to the first head unit, which belongs to the other row, in a direction intersecting the main scanning direction. The spur presses a recording paper from a side of the head unit. Accordingly, it is possible to suppress curling of the recording paper in a direction intersecting a transport direction.

18 Claims, 14 Drawing Sheets

LIQUID DROPLET JETTING APPARATUS

CROSS REFERENCE TO RELATED APPLICATION

The present application claims priority from Japanese Patent Application No. 2008-091651, filed on Mar. 31, 2008 the disclosures of which are incorporated herein by reference in its entirety.

BACKGROUND OF THE INVENTION

1. Field of the Invention

The present invention relates to a liquid droplet jetting apparatus which jets liquid droplets from nozzles formed in a head unit or head units.

2. Description of the Related Art

A line type ink-jet recording apparatus which records an image and characters by jetting droplets of an ink from nozzles of a recording head, on to a recording medium such as a paper which is transported by a transporting unit has hitherto been available. In such ink-jet recording apparatus, when the ink droplets jetted from the nozzles are landed on and permeated into the paper, an area of the paper in which the ink has permeated contracts in a planar direction, and an end portion near the area of the paper in which the ink has permeated tends to come closer to the recording head, and the paper is curled toward the recording head. When the curled paper makes a contact with a surface liquid droplet jetting surface) of the recording head in which the nozzles are formed, there is a fear to damage this surface, and a direction of jetting of liquid droplets from the nozzles may change. In this case, liquid droplet jetting characteristics may change. Therefore, pressing the paper is taken into consideration for preventing the curling of paper. For instance, Japanese Patent Application Laid-open No. 2005-29333 (FIG. 1) discloses an ink-jet recording apparatus which prevents the curling of a paper, including four recording heads arranged along a transport direction of a paper, and pressing members which press the paper toward the transporting unit and which are provided at positions between the adjacent recording heads and at another position located at an upstream side of the uppermost stream head in the transport direction.

SUMMARY OF THE INVENTION

However, when printing is carried out to daub a part of a paper, and when printing concentration differs in a width direction (a direction orthogonal to the transport direction), the paper is curled in the width direction. In the ink-jet recording apparatus described in Japanese Patent Application Laid-open No. 2005-29333, the pressing members which prevent the curling of the paper by pressing the paper is provided between the adjacent recording heads in the transport direction. Therefore, it is not possible to press an area of the paper facing the recording head in the width direction, and since it is not possible to suppress the curling of paper in the width direction, there is a fear that the curled paper comes in contact with a liquid droplet jetting surface of the recording head.

The present invention is made in view of the abovementioned circumstances, and an object of the present invention is to provide a liquid droplet jetting apparatus which is capable of suppressing a curling of a recording medium in one direction intersecting the transport direction.

According to a first aspect of the present invention, there is provided a liquid droplet jetting apparatus which jets liquid droplets of a liquid onto a sheet-shaped object, including:

a plurality of head units having liquid droplet jetting surfaces, respectively, in each of which a row of nozzles aligned in one direction is formed, the head units being arranged in a transport direction of the object intersecting the one direction;

a transporting mechanism which transports the object in the transport direction to a position at which the object faces the liquid droplet jetting surfaces of the plurality of head units; and a pressing mechanism which presses the object transported by the transporting mechanism, wherein two head units, among the plurality of head units, adjacent in the transport direction are arranged to be shifted in the one direction, and the pressing mechanism is arranged so as to be aligned in the one direction with one of the two adjacent head units, and to overlap with the other of the two adjacent head units in the transport direction.

According to the first aspect of the present invention, the head units adjacent in the transport direction are arranged to be shifted in the one direction (direction in which the nozzle row is aligned) intersecting the transport direction, and further, the pressing mechanism is arranged in that empty space. Accordingly, the head units and the pressing mechanisms are arranged in line in one direction. In other words, a position of the pressing mechanism with respect to the two adjacent head units in the transport direction differs in the one direction, and it is possible to suppress a curling of an object such as a recording paper in this direction.

According to a second aspect of the present invention, there is provided a liquid droplet jetting apparatus which jets liquid droplets of a liquid on a sheet-shaped object, including:

a head which includes a head unit having a liquid droplet jetting surface in which a plurality of nozzles is formed and a jetting area is defined by the plurality of nozzles, and two pressing mechanisms which are arranged to interpose the jetting area of the head unit therebetween, and which press the object; and a transporting mechanism which transports the object in a transport direction to a position at which the object faces the liquid droplet jetting surface of the head unit.

According to the second aspect of the present invention, since the two pressing mechanisms are arranged sandwiching the jetting area of the liquid droplet jetting surface, the pressing mechanisms are capable of pressing a portion of the object on which the liquid droplets are going to be jetted, and it is possible to reduce the curling of this portion.

In the two head units adjacent in the transport direction, the positions of the pressing mechanisms are misaligned in the direction in which the nozzles are arranged in a row. Accordingly, it is possible to suppress the curling of the object (recording medium) in this direction.

DETAILED DESCRIPTION OF THE PREFERRED EMBODIMENTS

Figure 1:
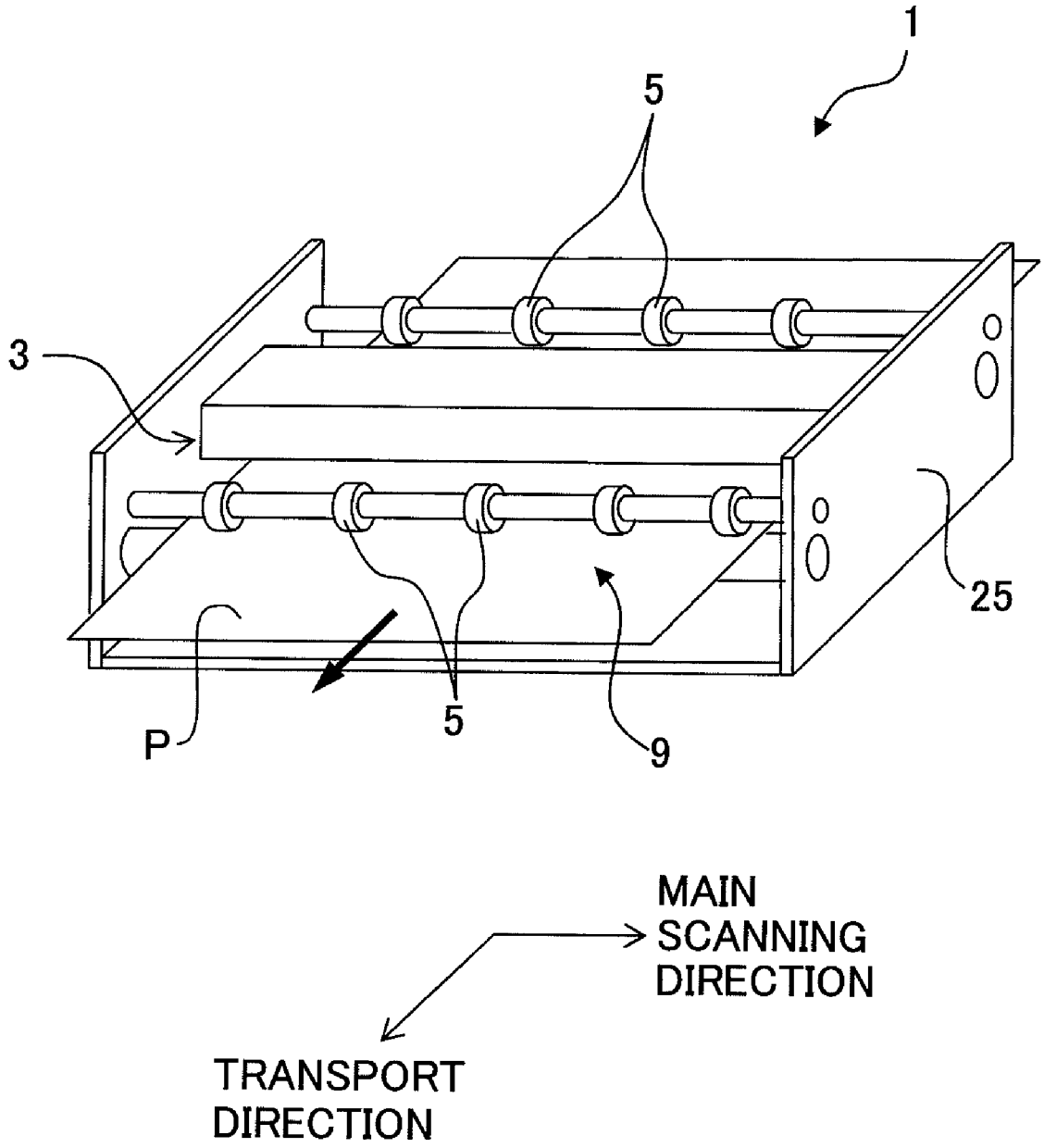
FIG. 1 is a schematic structural view of an ink-jet printer according to an embodiment of the present invention.

Next, an ink-jet printer according to an embodiment of the present invention will be described below. The ink-jet printer in the embodiment includes a line ink-jet head in which a plurality of head units and a plurality of spurs are arranged alternately in line along a predetermined direction. FIG. 1 is a schematic structural view of the ink-jet printer according to the embodiment of the present invention.

As shown in FIG. 1, an ink-jet printer 1 (liquid droplet jetting apparatus) includes a line ink-jet head 3 which is extended in a left-right direction in FIG. 1 (a first direction, a direction in which the line ink-jet head is extended, a direction in which a row of nozzles is extended, a main scanning direction), and which jets an ink onto a recording paper P (recording medium), and a transporting mechanism 9 which transports the recording paper P frontward (transport direction orthogonal to the main scanning direction: secondary scanning direction). The ink is jetted on to the recording paper P from the ink-jet head 3, while the recording paper P is transported frontward by the transporting mechanism 9. Then, the ink-jet printer 1 records a desired image and characters on the recording paper P. In this patent specification, the direction in which the line ink-jet head is extended is called as the main scanning direction. This has been named conventionally after a scanning direction of a serial ink-jet head, and it does not mean that the line ink-jet head is scanned in the main scanning direction.

The transporting mechanism 9 has two transporting rollers 5 arranged on both sides of the ink-jet head 3 in the transport direction. The recording paper P is transported in the transport direction by the transporting rollers 5 to a position at which the paper P faces an ink jetting surface 7 of the head unit 2 which will be described later.

Figure 2:
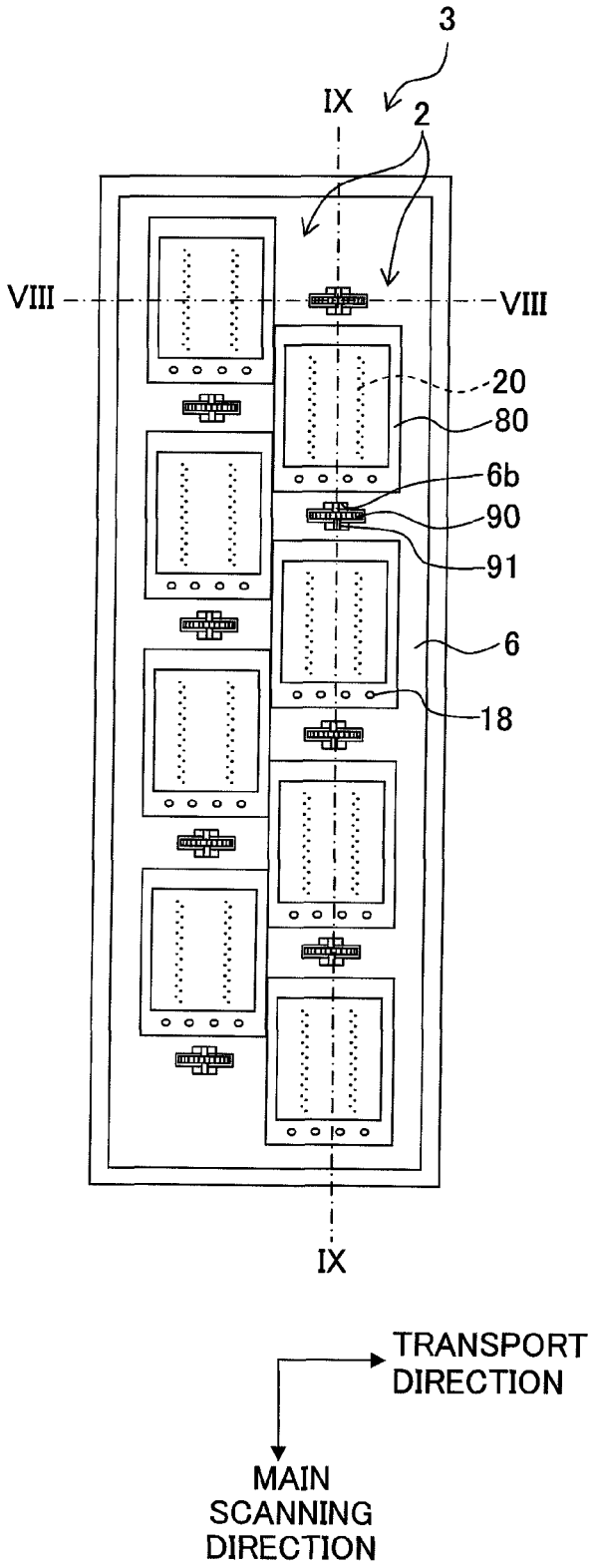
FIG. 2 is a plan view when an ink-jet head is seen from a top.
Figure 3:
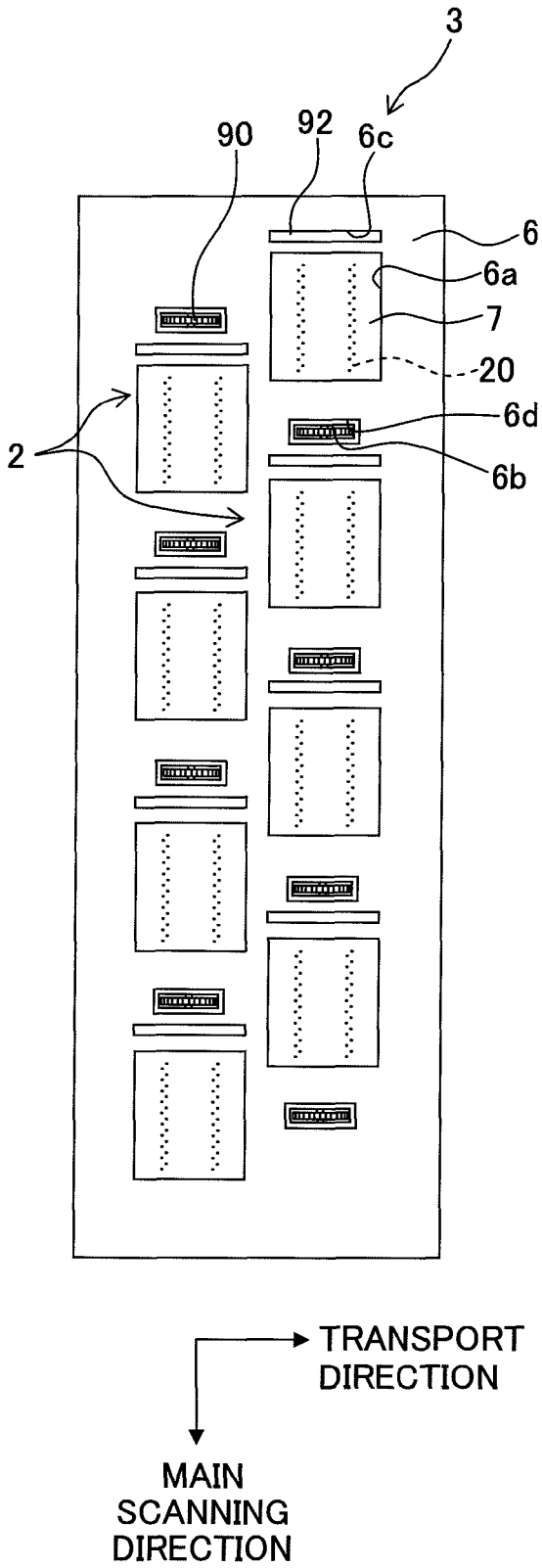
FIG. 3 is a plan view when the ink-jet head is seen from a bottom.
Figure 4:
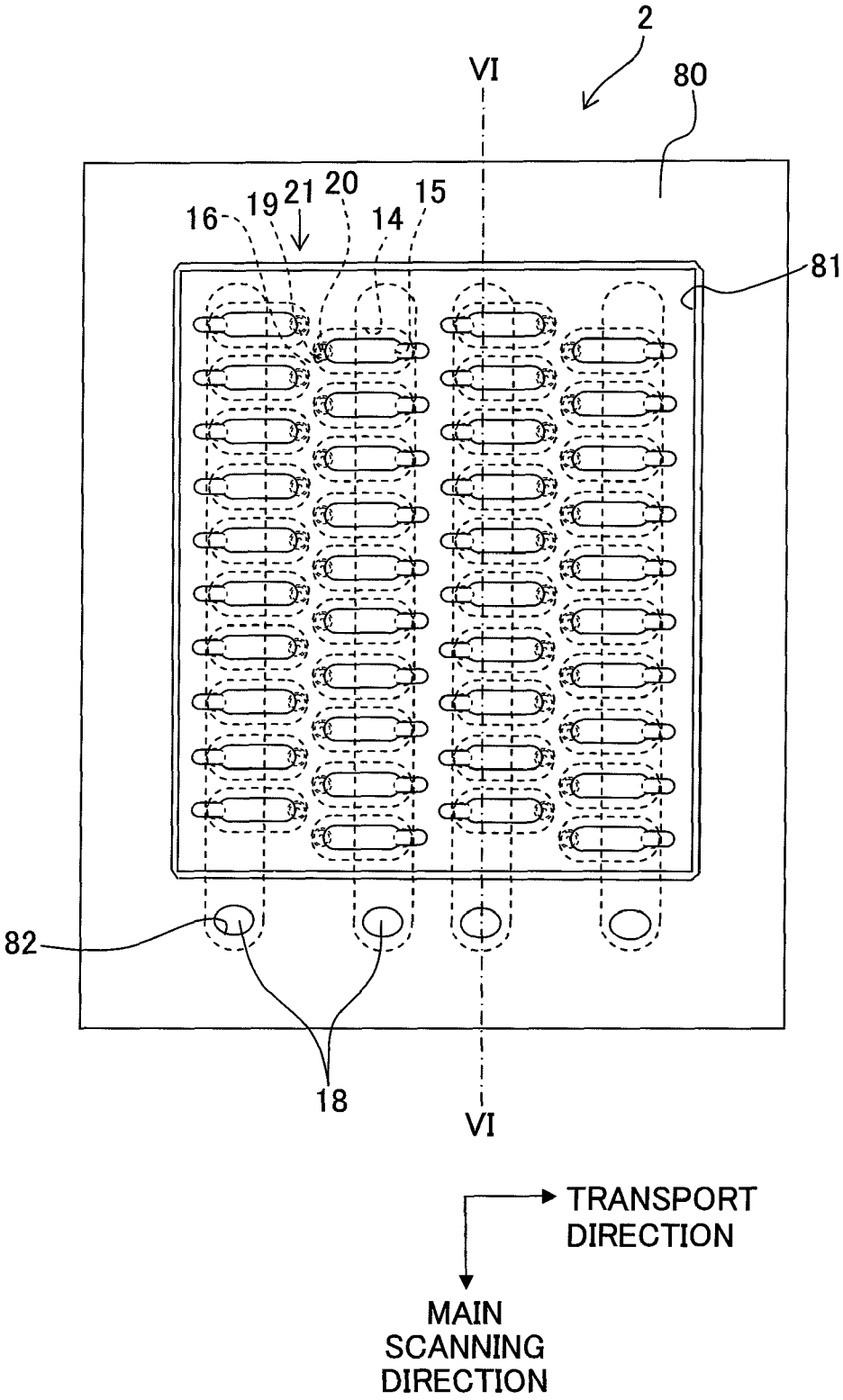
FIG. 4 is a plan view of a head unit.

Next, the ink-jet head 3 will be described below. FIG. 2 is a plan view when the ink-jet head 3 is seen from a top. FIG. 3 is a plan view when the ink-jet head 3 is seen from a bottom. However, for making the diagrams easily understandable, pressure chambers 14, and through holes 15, 16, and 19 shown in FIG. 4 are omitted in FIG. 2.

As shown in FIGS. 2 and 3, the ink-jet head 3 includes a plurality of head units 2 arranged in two rows in a zigzag form in the main scanning direction, a plurality of spurs 90 (pressing mechanisms) arranged alternately with the plurality of head units 2 in the main scanning direction, and a housing 6 (supporting member) which supports a rotating shaft 91 of the plurality of spurs 90 and the plurality of head units 2.

Figure 5:
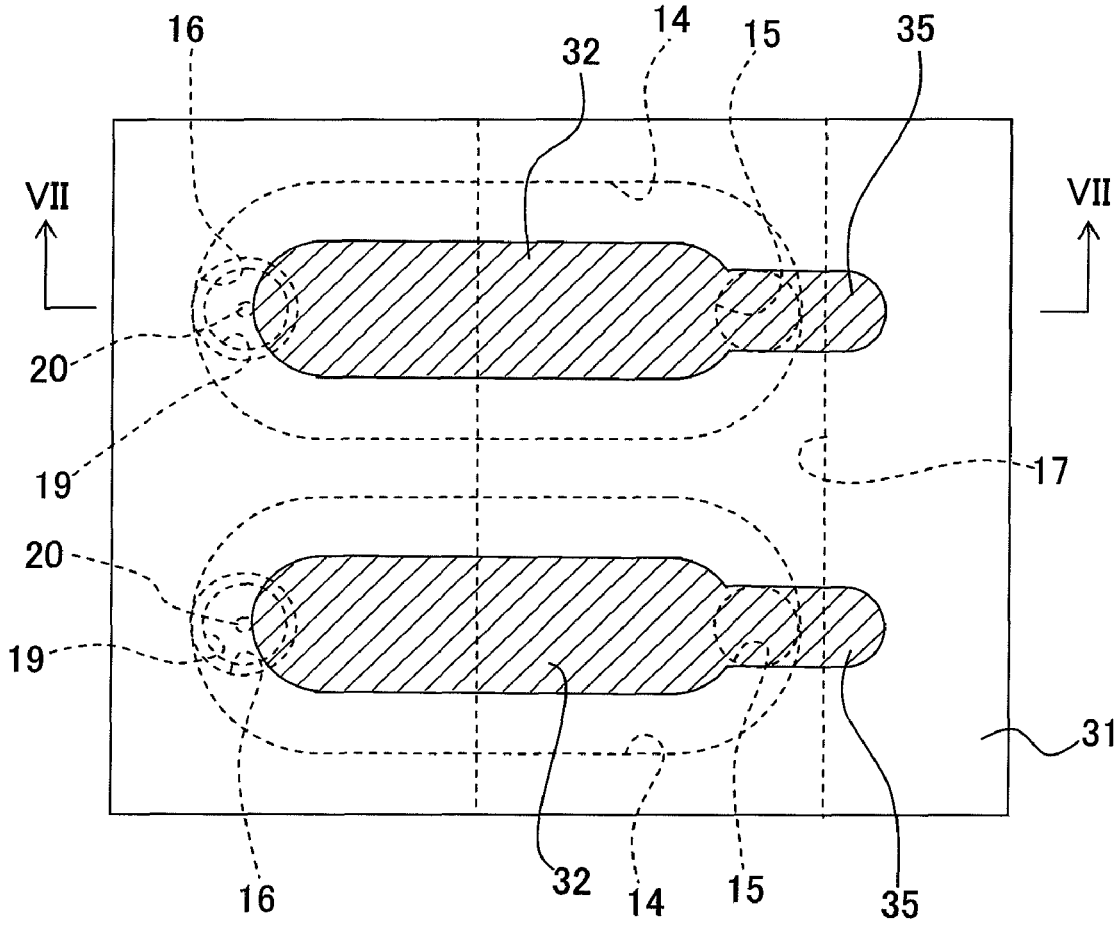
FIG. 5 is a partially enlarged view of FIG. 4.
Figure 6:
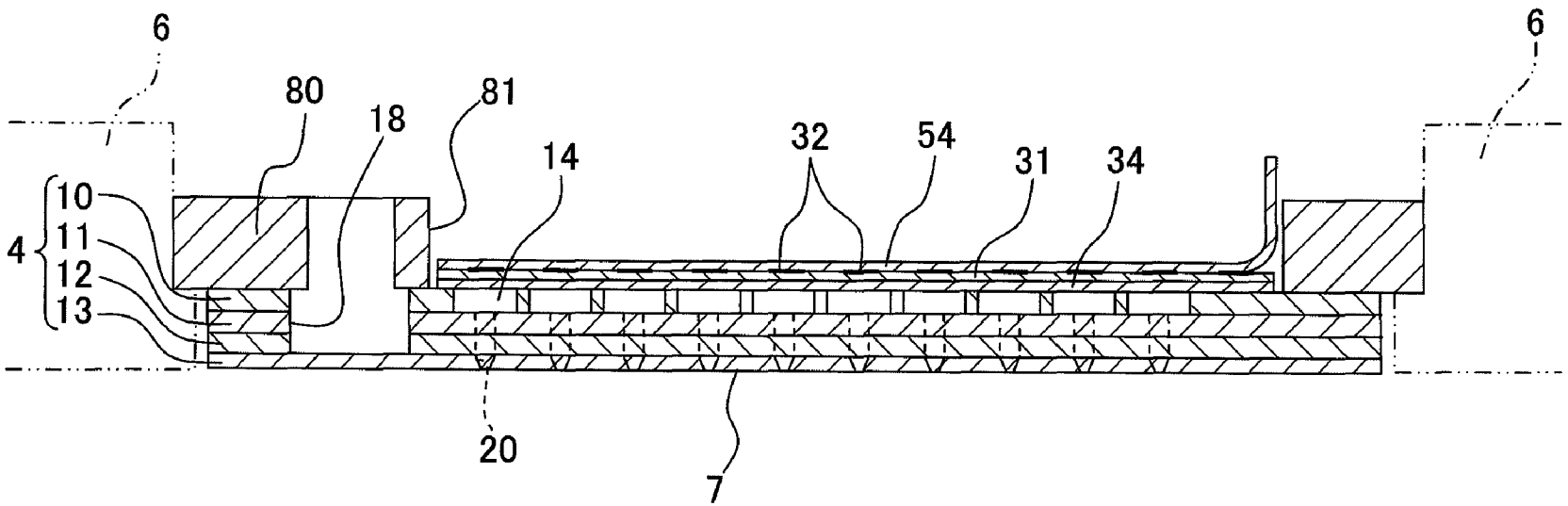
FIG. 6 is a cross-sectional view taken along a VI-VI line in FIG. 4.
Figure 7:
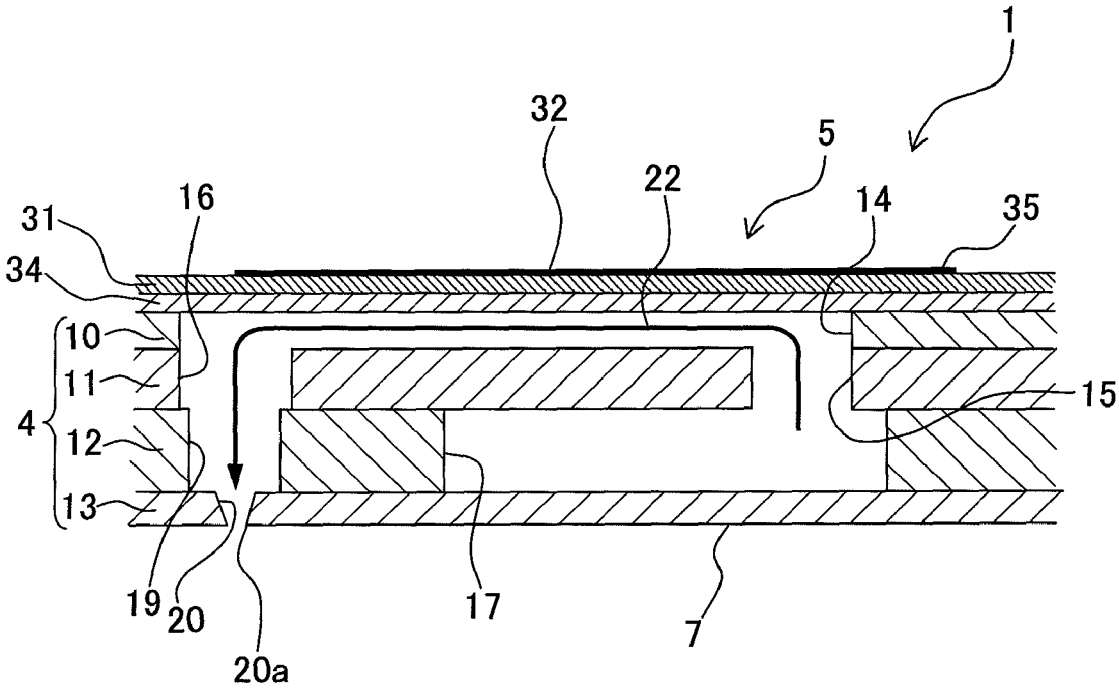
FIG. 7 is a cross-sectional view taken along a VII-VII line in FIG. 5.

Firstly, the head units 2 will be described below. FIG. 4 is a plan view of one of the head units 2. FIG. 5 is a partially enlarged view of FIG. 4. FIG. 6 is a cross-sectional view taken along a VI-VI line in FIG. 4. FIG. 7 is a cross-sectional view taken along a VII-VII line in FIG. 5. As shown in diagrams from FIGS. 4 to 7, each of the head units 2 has a channel unit 4 in which individual ink channels 22 including nozzles 20 and the pressure chambers 14 are formed, a piezoelectric actuator 5 which makes jet the ink from the nozzles 20 of the channel unit 4 by applying a pressure to the ink in the pressure chambers 14, and a reinforcing plate 80 which reinforces the channel unit 4.

As shown in diagrams from FIGS. 4 to 7, the channel unit 4 includes a cavity plate 10, a base plate 11, and a manifold plate 12 which are formed of a metallic material such as stainless steel, and a nozzle plate 13 which is formed of a high-molecular synthetic resin material such as polyimide, and these four plates 10, 11, 12, and 13 (hereinafter, plates 10 to 13) are joined in a stacked form.

The nozzles 20 are formed as a plurality of through holes in the nozzle plate 13. The plurality of nozzles 20 form four nozzle rows 21 arranged, side by side, in the transport direction, and each of the nozzle rows 21 is extended in the main scanning direction (vertical direction in FIG. 4). Inks of four colors namely black, yellow, cyan, and magenta are jetted from the nozzles 20 belonging to the four nozzle rows 21, respectively. A lower surface of the nozzle plate 13 in which the plurality of nozzles 20 are formed is an ink jetting surface 7 (liquid droplet jetting surface).

The plurality of pressure chambers 14 corresponding to the plurality of nozzles 20 is formed in the cavity plate 10. Each of the pressure chambers 14 has a substantially elliptical shape elongated in the transporting direction. The pressure chambers are arranged such that one end portion of each of the pressure chambers 14 overlaps with one of the nozzles 20. In other words, a longitudinal direction of each of the pressure chambers 14 is parallel to the transport direction. Moreover, through holes 15 and 16 are formed in the base plate 11, at positions overlapping with two end portions of each of the pressure chambers 14 in the longitudinal direction in a plan view.

Four manifold channels 17 corresponding to the four nozzle rows 21 respectively are formed in the manifold plate 12. Each of the manifold channels 17 is extended in the main scanning direction at a position away from the nozzles 20 of the corresponding nozzle row 21 in the transport direction, and each of the manifold channels 17 overlaps with a substantial half portion of the corresponding pressure chambers 14. Moreover, as shown in FIG. 4, one end portion (lower-end portion in FIG. 4) of the four manifold channels 17 communicate with four ink supply ports 18 respectively, formed in the cavity plate 10 which is the uppermost plate in the stacked plates 10 to 13. The four ink supply ports 18 are connected to four ink tanks respectively, which are not shown in the diagram, and the ink in each of the ink tanks is supplied to one of the manifold channels 17 through one of the ink supply ports 18. Moreover, through holes 19 are formed in the manifold plate 12, at positions overlapping with both the through holes 16 in the base plate 11 and the nozzles 20 of the nozzle plate 13 in a plan view.

Moreover, as shown in FIGS. 6 and 7, in the channel unit 4, each of the manifold channels 17 communicating with one of the ink supply ports 18 communicates with the pressure chambers 14 via the through holes 15, and the pressure chambers 14 further communicate with the nozzles 20 via the through holes 16 and 19. In other words, a plurality of individual ink channels 22 which are mutually independent is formed in the channel unit 4, and each of the individual ink channels 22 runs from an outlet of one of the manifold channels 17 up to the nozzles 20 via the pressure chambers 14.

The piezoelectric actuator 5 includes a vibration plate 34, a piezoelectric layer 31, and a plurality of individual electrodes 32. The vibration plate 34 is made of an electroconductive material such as a metallic material, and is joined to an upper surface of the cavity plate 10 to cover the plurality of pressure chambers 14. Moreover, the electroconductive vibration plate 34 also serves as a common electrode for generating an electric field in a portion of the piezoelectric layer 31 arranged between the plurality of individual electrodes 32 as it will be described later. The vibration plate 34 is connected to a ground wire (ground terminal) and is kept all the time at a ground electric potential.

The piezoelectric layer 31 is made of a piezoelectric material which is principally composed of lead zirconate titanate which is a mixed crystal of lead titanate and lead zirconate, and which is a ferroelectric substance, and is arranged continuously on an upper surface of the vibration plate 34, to be spread over the plurality of pressure chambers 14. Moreover, the piezoelectric layer 31 is polarized in advance in a thickness direction thereof (a stacking direction of the channel unit, vibration plate and the piezoelectric layer).

The plurality of individual electrodes 32 is provided on an upper surface of the piezoelectric layer 31, corresponding to the plurality of pressure chambers 14. Each of the individual electrodes 32 has a substantially elliptical shape slightly smaller than the corresponding pressure chamber 14, and is arranged on the upper surface of the piezoelectric layer 31, at a position overlapping with a substantially central portion of the corresponding pressure chamber 14. Moreover, one end portion (right-end portion in FIG. 5) in a longitudinal direction of each of the individual electrodes 32 is extended toward right-side up to a position not overlapping with the corresponding pressure chamber 14 in a plan view, and a front-end portion of the one end portion is a contact point 35. One end of a flexible printed circuit (FPC) 54 is connected to the contact point 35 (refer to FIG. 6). The other end of the FPC 54 is connected to a driving circuit not shown in the diagram. The driving circuit selectively applies one of a predetermined driving electric potential and the ground electric potential to the individual electrodes 32.

An operation of the piezoelectric actuator 5 having an abovementioned structure will be described below. When the pressure is not applied to the ink (when droplets of ink are not jetted from the nozzles 20), the electric potential of the plurality of individual electrodes 32 is kept at the ground electric potential in advance. From this state, when the predetermined driving electric potential is applied to any of the plurality of individual electrodes 32 via the FPC 54, an electric potential difference is generated between the individual electrodes 32 to which the driving electric potential is applied and the vibration plate 34 serving as the common electrode which has been held at the ground electric potential, and an electric field in the thickness direction of the piezoelectric layer is generated in a portion of the piezoelectric layer 31 (an active portion), sandwiched between the individual electrodes 32 and the vibration plate 34. Here, when a polarization direction of the active portion of the piezoelectric layer 31 is same as a direction of the electric field, the piezoelectric layer 31 elongates in the thickness direction and contracts in an in-plane direction (a plane direction) of the piezoelectric layer 31. Moreover, when a contraction-deformation (deformation due to contraction) of the piezoelectric layer 31 is occurred, a portion of the vibration plate 34 facing the pressure chambers 14 is deformed to form a projection toward the pressure chambers 14 (unimorph deformation). At this time, since a volume of the pressure chambers 14 is decreased, a pressure applied to the ink rises up, and droplets of the ink are jetted from the nozzles 20 communicating with the pressure chambers 14.

Next, the reinforcing plate 80 will be described below. As shown in FIGS. 4 and 6, the reinforcing plate 80 is formed of a metallic material such as stainless steel, and is sufficiently thicker than the channel unit 4, and has a high stiffness. Moreover, the reinforcing plate 80 has a rectangular shape larger than an outer shape of the channel unit 4. An opening 81 having a rectangular shape slightly larger than an outer shape of the piezoelectric actuator 5 in a plan view, is formed at a central portion of the reinforcing plate 80, and the piezoelectric actuator 5 is accommodated in the opening 81. Moreover, four openings 82 are formed at one end portion of the reinforcing plate 80 (lower-end portion in FIG. 4), at positions overlapping with the four ink supply ports 18 in the channel unit 4 in a plan view. The reinforcing plate 80 is joined to the upper surface of the cavity plate 10. The reinforcing plate 80 is arranged to be parallel to the ink jetting surface 7, and the piezoelectric actuator 5 is accommodated in the opening 81. The reinforcing plate 80 has a function of reinforcing the channel unit 4 so that there is no shift in a jetting direction of the ink jetted from the nozzles 20 due to bending of the channel unit 4.

Next, the housing 6 will be described below. As shown in FIGS. 2 and 3, the housing 6 has a rectangular shape in a plan view, and is supported by a casing (housing) 25 (refer to FIG. 1) to be ascendable/descendible in a vertical direction by an ascending/descending mechanism (elevating mechanism, lifting mechanism) which is not shown in the diagram. Moreover, a plurality of openings **6*a* and 6*b* are formed in the housing 6, the openings 6*a* being arranged in two rows in a zigzag form in the main scanning direction at positions corresponding to positions at which the plurality of head units 2 are arranged, and openings 6*b* being arranged alternately with the plurality of openings 6*a* at positions corresponding to positions at which the plurality of spurs 90** are arranged.

The channel unit 4 is accommodated in each of the openings **6*a* such that the ink supply port 18 of the head unit 2 is positioned at a lower side in FIG. 2, and that the row direction of the nozzles is parallel to the main scanning direction. The channel unit 4 is accommodated such that the ink jetting surface 7 faces parallel to the recording paper P which is transported by the transporting rollers 5. Moreover, a lower surface of the reinforcing plate 80 is joined to an upper surface of the housing 6. Accordingly, the plurality of head units 2 are fixed to the housing 6. In this manner, two head units 2 adjacent in the transport direction are arranged to be mutually misaligned (mutually shifted) in the main scanning direction. A lower surface of the housing 6 and the ink jetting surface 7** are positioned on the same plane.

Moreover, in one head unit 2, a distance between two nozzles 20 adjacent in the main scanning direction is same as a distance between the two nozzles 20 included in the two adjacent head units 2 respectively, and at the nearest position in the main scanning direction. In other words, when a group (a set) of the plurality of head units 2 arranged in a zigzag manner in two rows is considered as one line-type ink-jet head 3, the nozzles 20 adjacent in the main scanning direction are arranged at mutually same distance.

Figure 8:
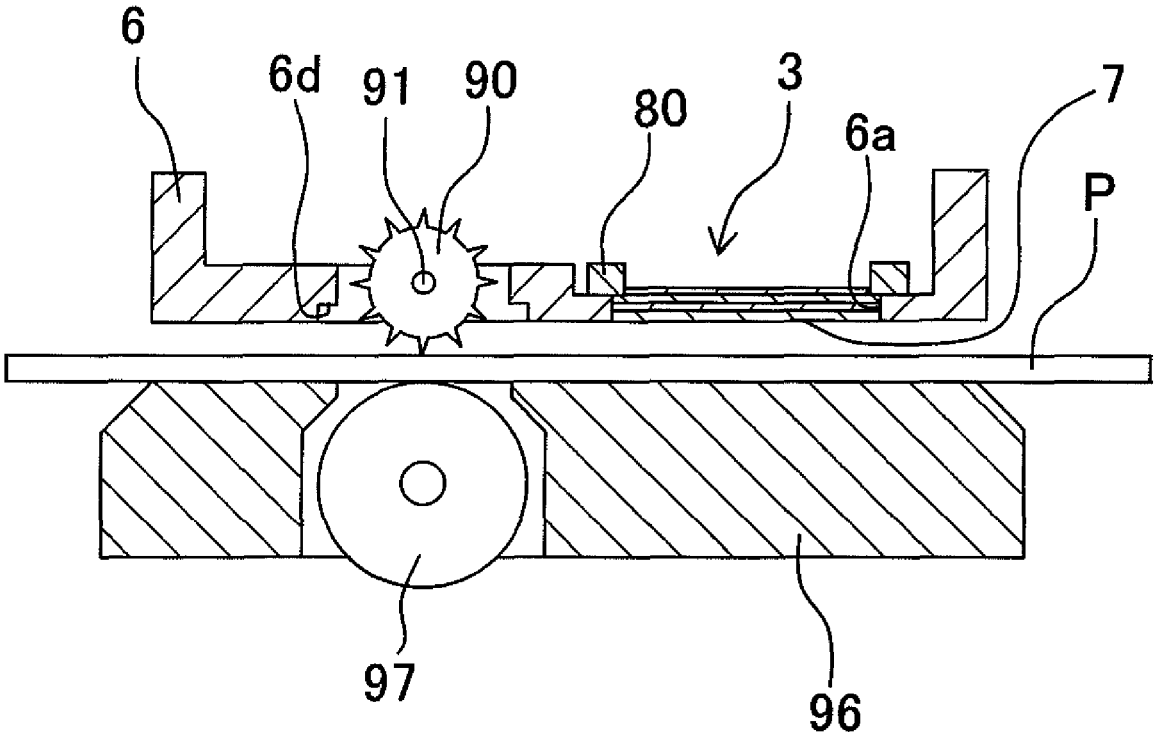
FIG. 8 is a cross-sectional view taken along a VIII-VIII line in FIG. 2.
Figure 9:
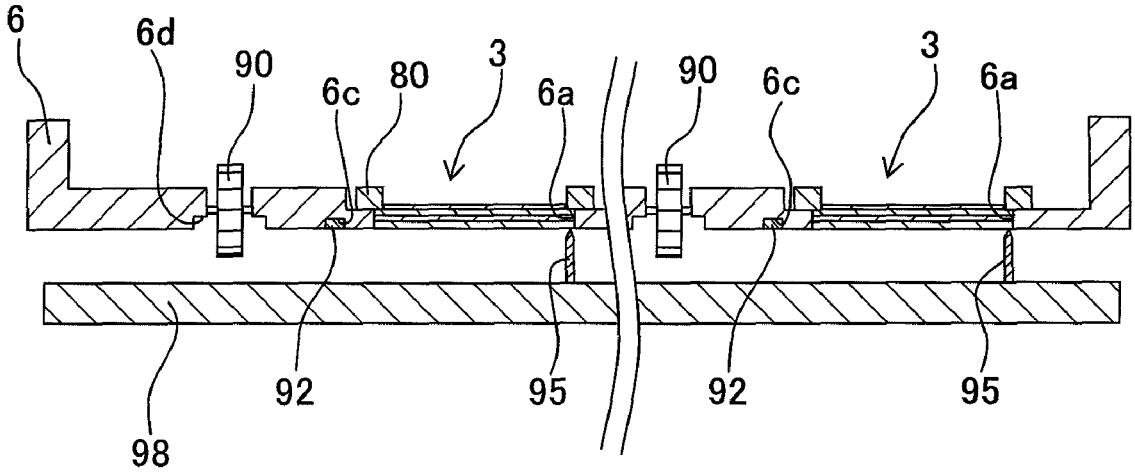
FIG. 9 is a cross-sectional view taken along a IX-IX line in FIG. 2.

The spur 90 and the rotating shaft 91 are arranged in each opening **6*b*. A position at which the spur 90 is arranged will be described below. FIG. 8 is a cross-sectional view taken along a VIII-VIII line in FIG. 2. FIG. 9 is a cross-sectional view taken along a IX-IX line in FIG. 2. As shown in FIG. 2, both ends of the rotating shaft 91 are supported by an end surface (an edge surface) defining the opening 6***b* such that an axial direction of the rotating shaft 91 is parallel to the main scanning direction. Moreover, the height position of the spur 90 is adjusted such that it can rotate while making a contact with the recording paper P transported by the transporting mechanism 9 (refer to FIG. 8). In other words, the spur 90 is arranged to be aligned with one head unit 2, in the scanning direction, belonging to one of the rows of the head units 2, and is arranged to overlap with another head unit 2 belonging to the other row, adjacent to the one head unit 2 in the transport direction. In this manner, since a member which supports the spur 90 also serves as the housing 6 which supports the head units 2, the structure is simple, and it is possible to reduce a cost. Since an area, of the spur 90, at which the spur 90 makes contact with the recording paper P is small, there is no fear of leaving stains on the recording paper P, even when a liquid is adhered to the spur.

Moreover, as shown in FIG. 8, a drive roller 97 is arranged at a position facing the spur 90, and between the two transporting rollers 5 in the transport direction. The drive roller 97 is supported by a supporting member 96, and is driven by a drive motor which is not shown in the diagram. In other words, a pair of rollers is formed by the spur 90 and the drive roller 97, and the recording paper P transported by the transporting mechanism 9 is pinched (is held) between the spur 90 and the drive roller 97. Moreover, the spur 90 rotates while making a contact with the recording paper P transported by the transporting mechanism 9, and presses the recording paper P from a side of the ink jetting surface 7.

Here, when droplets of ink are jetted from the nozzles 20 of the ink-jet head 3 on to a part of the recording paper P which is transported by the transporting mechanism 9, an area of the recording paper P, on which a large amount of ink is landed and permeated, contracts in a in-plane direction of the recording paper P. Or, even when the droplets of ink are jetted from the nozzles 20 of each ink-jet head 3 such that the concentration of ink differs along the main scanning direction, the area of the recording paper P, on which a large amount of ink is landed and permeated, contracts in the in-plane direction. Moreover, an end portion of the recording paper P in the main scanning direction, which is a portion overlapping with the area, in the main scanning direction, on which the ink has landed and permeated, is curled toward the head unit 2, and the curled portion of the recording paper P tends to be closer to the head unit 2. However, in the two head units 2 adjacent in the transport direction, positions of the spurs 90 arranged corresponding to these head units 2 is shifted in the main scanning direction. In other words, the head units 2 are arranged in a zigzag form along the main scanning direction of the ink-jet head 3 whereas, the spurs 90 are arranged in a zigzag form along the main scanning direction of the ink-jet head 3. Since the recording paper P is pressed by the spur 90, it is possible to suppress the curling of the recording paper P in the main scanning direction. Moreover, since the plurality of spurs 90 is arranged alternately in the main scanning direction with the plurality of head units 2, it is possible to suppress more assuredly the curling of the recording paper P in the main scanning direction. Since the spurs 90 are arranged in a dead space in the housing 6, at which the head units 2 are not arranged, a size reduction (making a size small) of the ink-jet head 3 is not hindered. In this manner, it is possible to arrange the spurs in the dead space when one head unit is formed to have a plurality of divided (split) head units 2, that is, the one head unit is not formed to have a single ink-jet head extended in the main scanning direction.

Moreover, as shown in FIGS. 8 and 9, recesses 6*d* each slightly larger than the opening 6*b* which is arranged to enclose one of the spurs 90 are formed in the lower surface of the housing 6. When the droplets of ink are jetted from the nozzles 20, there is a fear that the ink droplets which are not landed on the recording paper P remains on the ink jetting surface 7 and adheres to the spurs 90. Then, the recording paper P may be stained by these spurs 90. However, when the recess 6*d* is formed to enclose the spur 90, the ink adhered to the ink jetting surface 7 of the head unit 2 is accumulated in the recess 6*d* before reaching the spur 90, and is prevented from reaching the spur 90. In this manner, it is possible to prevent the ink from adhering to the spur 90 by the recess 6*d* which can be formed easily.

Moreover, as shown in FIGS. 3 and 9, a plurality of recesses 6*c* is formed in a surface of the housing 6, facing the recording paper P which is transported by the transporting mechanism 9, and a sponge 92 (liquid holding mechanism) which is an absorber is disposed inside each recess 6*c*. The recess 6*c* is formed at an upper side (upper side in FIG. 3) of the corresponding opening 6*a* (head unit 2) in a plan view. The sponge 92, as it will be described later, absorbs ink which is wiped off, by a wiper 95, from the ink jetting surface 7.

As shown in FIG. 9, a plurality of wipers 95 is provided on a supporting member 98, corresponding to each of the ink jetting surfaces 7. The supporting member 98, normally, is retracted at a position away from the ink-jet head 3. At the time of wiping, the ink-jet head 3 ascends up by an ascending/descending mechanism not shown in the diagram. Accordingly, a predetermined space is generated between the ink-jet head 3 and the transporting mechanism 9. The supporting member 98 which includes the wiper 95 moves to the predetermined space facing the ink jetting surface 7 of the ink-jet head 3, by a moving mechanism not shown in the diagram. Next, the ink-jet head 3 descends such that a front-end portion of the wiper 95 makes a contact with the ink jetting surface 7 of the ink-jet head 3. Furthermore, the supporting member 98 moves from a right side to a left side (a wiping direction) in FIG. 9 along the main scanning direction. At this time, the ink adhered to the ink jetting surface 7 is wiped off by the wiper 95. In the above case, The wiping direction is directed from a lower side to an upward side (upward direction) in FIG. 3.

Moreover, since the sponge 92 is arranged at a downstream side in the wiping direction, the ink wiped off is absorbed and held by the sponge 92. Consequently, the ink adhered to the ink jetting surface 7 hardly flows to the spurs 90. A mechanism which holds the ink that is wiped off by the wiper such that the ink adhered to the ink jetting surface 7 hardly flows to the spur 90 is not restricted to the sponge 92. For instance, it may be the recess 6*c* without the sponge 92 disposed therein. Moreover, the recess 6*c* may be a cavity cut through a thickness direction of the housing 6, and a sponge may be disposed in the cavity.

Figure 10:
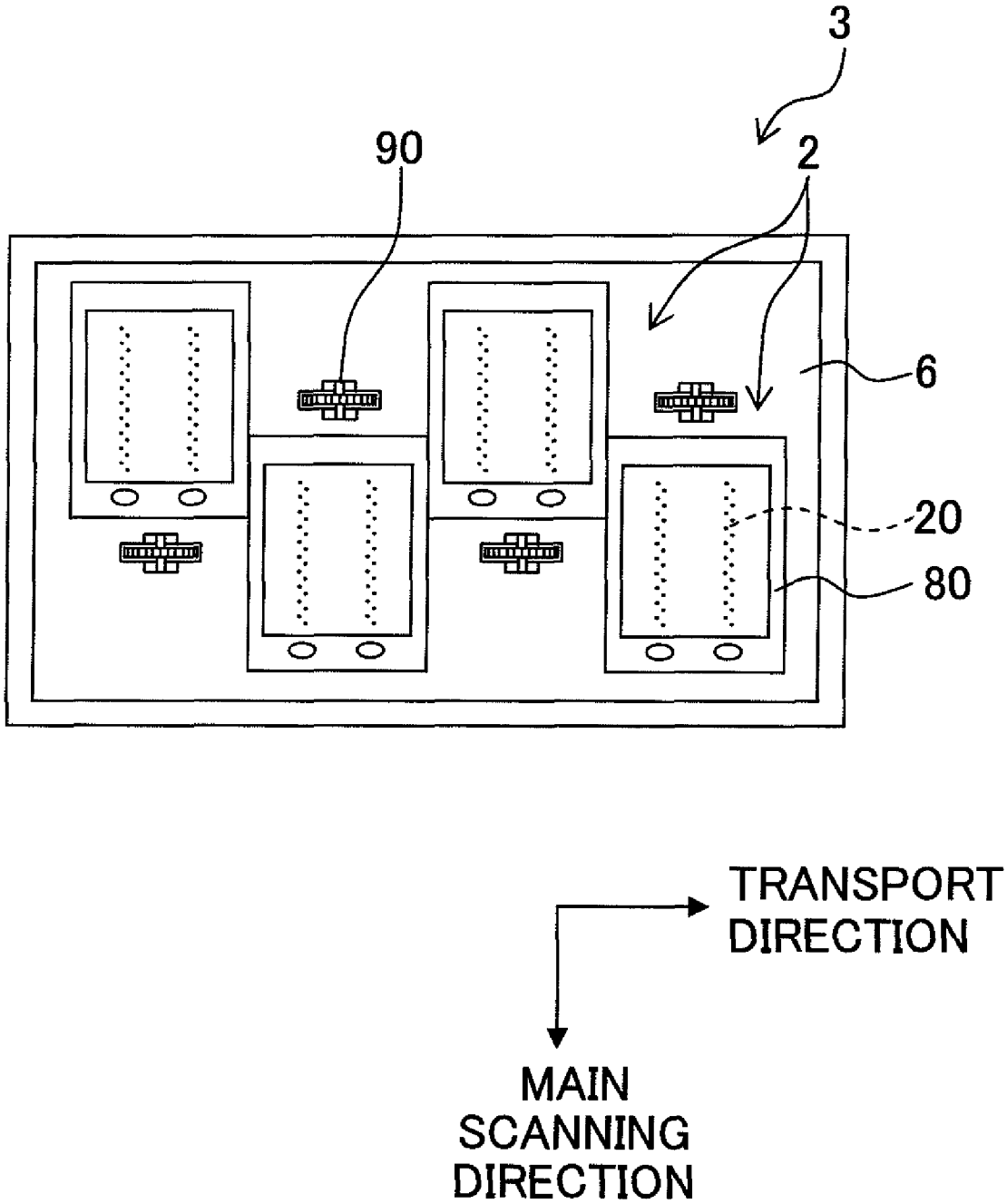
FIG. 10 is a plan view when ink-jet heads arranged in four rows in the head unit are seen from a top.

Next, modified embodiments in which various modifications are made in the abovementioned embodiment will be described below. However, the modified embodiments described below are mere exemplifications, and the present invention is not restricted to these modified embodiments. In the embodiment described above, the plurality of head units 2 are arranged in zigzag form in two rows along the main scanning direction of the housing 6 as shown in FIG. 2. However, the plurality of head units 2 may be arranged in four rows along the main scanning direction as shown in FIG. 10. In this case, it is possible to double a resolution since the two rows of the head units 2 are arranged at a left side in FIG. 10 to be misaligned (shifted) by a half pitch in the main scanning direction with respect to the two rows of the head units 2 at a right side. When a width of the recording paper P is narrow, the number of head units 2 belonging to each row may be one. In this case, the spur 90 is arranged to be aligned in the main scanning direction with one head unit 2, and to overlap with the other adjacent head unit 2 with the corresponding head unit 2 in the transport direction. Even in this structure, the positions of the spurs 90 arranged corresponding to the head units 2 adjacent in the transport direction are mutually different in the main scanning direction. Therefore, it is possible to suppress the curling of the recording paper P in the main scanning direction.

Figure 11:
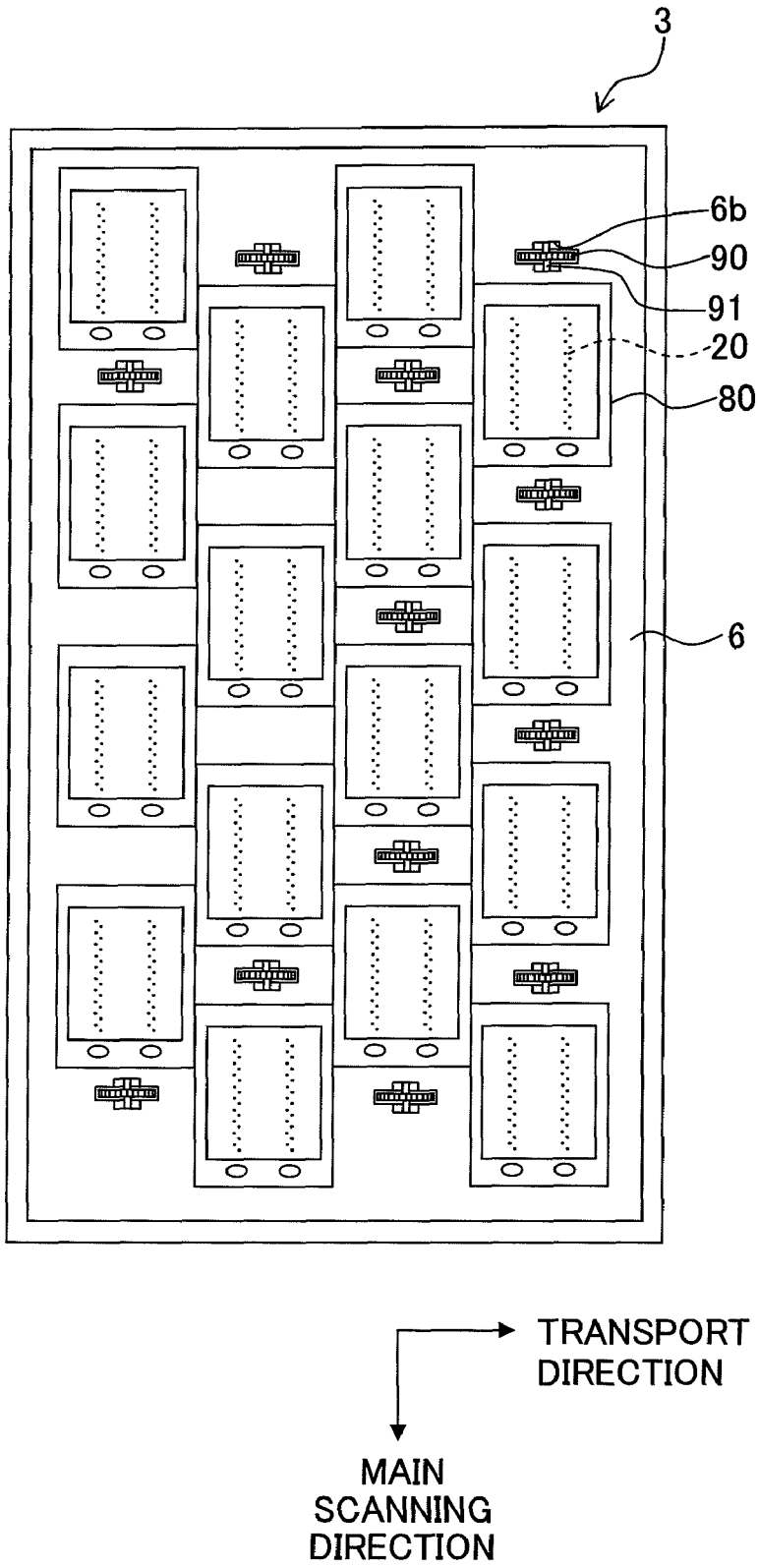
FIG. 11 is a plan view when an ink-jet head having a different density of arrangement of spurs for each row in a main scanning direction is seen from a top.

Moreover, a density of arrangement of the spurs 90 at the upstream side in the transport direction may be lower than a density of arrangement of the spurs 90 at the downstream side in the transport direction. For instance, as shown in FIG. 11, at the extreme downstream side in the transport direction (right side in FIG. 11), one spur 90 each corresponding to each head unit 2 is arranged in the row of the head units 2 arranged along the main scanning direction. Whereas, at the extreme upstream side in the transport direction (left side in FIG. 11), two spurs 90 are arranged to sandwich the row of the head units 2 arranged along the main scanning direction. An amount of ink jetted on to the recording paper P at the upstream side in the transport direction is still small, and moreover, it takes time for the recording paper P starting to be curled after the ink is landed thereon. Therefore, it is possible to make small the number of spurs to be provided for suppressing the curling at the upstream side as compared to those at the downstream side in the transport direction.

Figure 12:
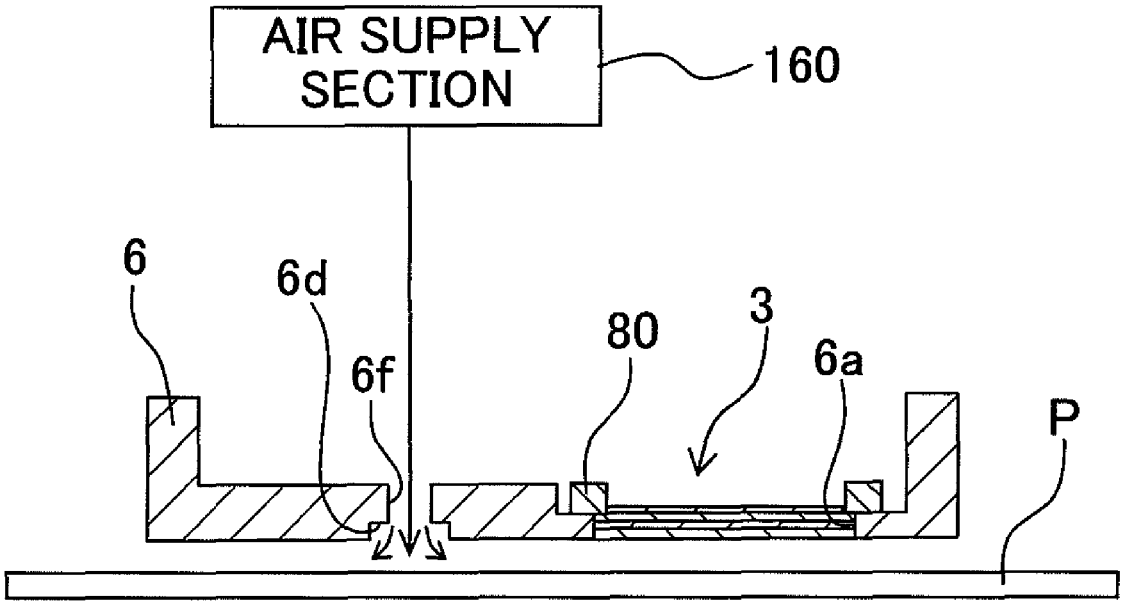
FIG. 12 is a diagram explaining a modified embodiment of a pressing mechanism.

Furthermore, a pressing mechanism which presses the recording paper P from the side of the ink jetting surface 7 toward the transporting mechanism 9 is not restricted to the spurs. As shown in FIG. 12, an opening 6*f* which is cut through a thickness direction of the housing 6 is formed in the housing 6, and an air supply section 160 including a pump etc. which supplies air toward the opening 6*f* are provided with the housing 6 instead of the spurs. The recording paper P may be pressed by jetting air from the air supply section 160 through the opening 6*f* onto the recording paper P transported by the transporting mechanism 9. When the pressing mechanism presses the printing paper P, the pressing mechanism and the printing paper P do not make a contact with each other. Therefore, there is no possibility of the ink adhering to the printing paper P, since the pressing mechanism never make a contact with the printing paper P. When the ink adhered to the ink jetting surface 7 flows into the opening 6*f*, there is a fear that the opening 6*f* is blocked (clogged), and that the ink flowed into the opening 6*f* is sprinkled (scattered) toward the recording paper P when the air is blown by the air supply section 160. Therefore, it is preferable to form the recess 6*d* to prevent the ink from flowing into the opening 6*f*.

Figure 13:
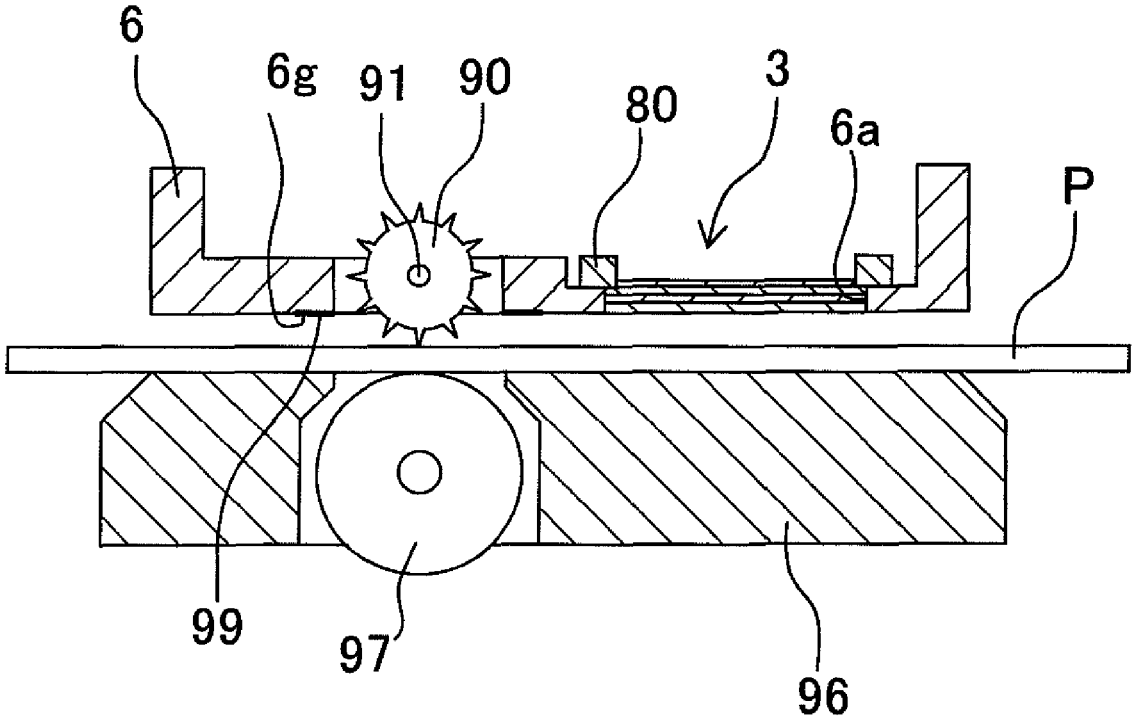
FIG. 13 is a diagram explaining a modified embodiment of an inhibiting mechanism.

Moreover, a mechanism which prevents the ink from adhering to the spurs 90 is not restricted to the recess 6*d*. For instance, as shown in FIG. 13, in spite of the recess 6*d*, a liquid repellent area 99 having a high liquid repellent property may be formed locally in an area 6*g* of the housing 6 by applying a fluororesin so as to enclose the spur 90. Accordingly, since the ink adhered to the ink jetting surface is repelled by the liquid repellent area 99, it is possible to prevent the ink from adhering to the spur 90. Since the liquid repellent area 99 is an area on which a fluororesin is applied, it is possible to form the liquid repellent area 99 easily. The liquid repellent area 99 is not restricted to be formed by applying a fluororesin, and it is possible to form the liquid repellent area 99 by using an arbitrary material provided that it is possible to make the liquid repellent property thereof superior as compared to a liquid repellent property of the surrounding area.

Moreover, in the embodiment, four nozzle rows 21 have been formed in the channel unit 4 of one head unit 2 so that color printing by four colors is possible. When an ink to be used is only black ink as in black-and-white printing, only one nozzle row 21 capable of jetting the black ink is to be formed in the channel unit 4 of one head unit 2.

Moreover, in the embodiment, the wiper 95 has been moving in the wiping direction. However, an arrangement may be such that the wiper 95 does not move, and the ink jetting surface 7 moves in the wiping direction by the movement of the ink-jet head 3, and the ink adhered to the ink jetting surface 7 is wiped off by the wiper 95. In other words, the ink adhered to the ink jetting surface 7 may be wiped off by the wiper 95 by a movement of the ink jetting surface 7 relative to the wiper 95.

In the embodiment described above, the spurs as the pressing mechanisms, have been supported by the housing which supports the head units. However, the present invention is not restricted to such arrangement, and for instance, the pressing mechanisms may be provided integrally with the head units, and the supporting member which supports the pressing mechanisms may be provided independently of the supporting member which supports the head units.

Figure 14:
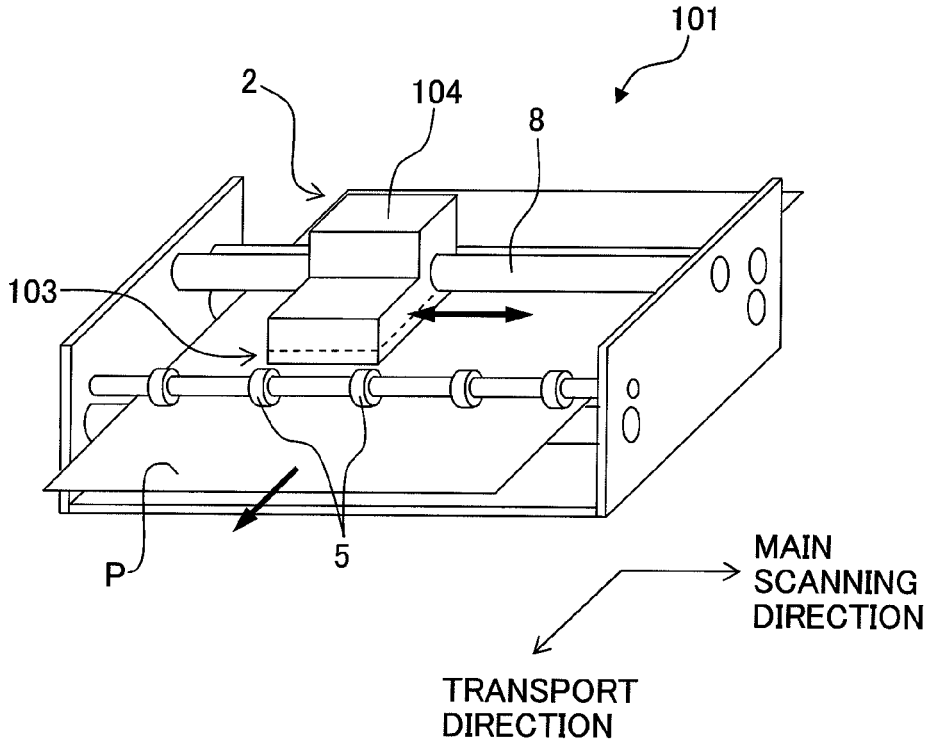
FIG. 14 is a schematic structural view of an ink-jet printer having a serial head according to modified embodiment of the present invention.

In the embodiment described above, the ink-jet head 3 includes the plurality of head units 2. However, the ink-jet head 3 may include only one head unit 2. For instance, the present invention, as shown in FIG. 14, is also applicable to an ink-jet printer 101 which includes a serial ink-jet head 103, a carriage 104 which scans in a scanning direction with the ink-jet head 103 mounted thereon, and a transporting mechanism 5 which transports the recording paper P.

Figure 15:
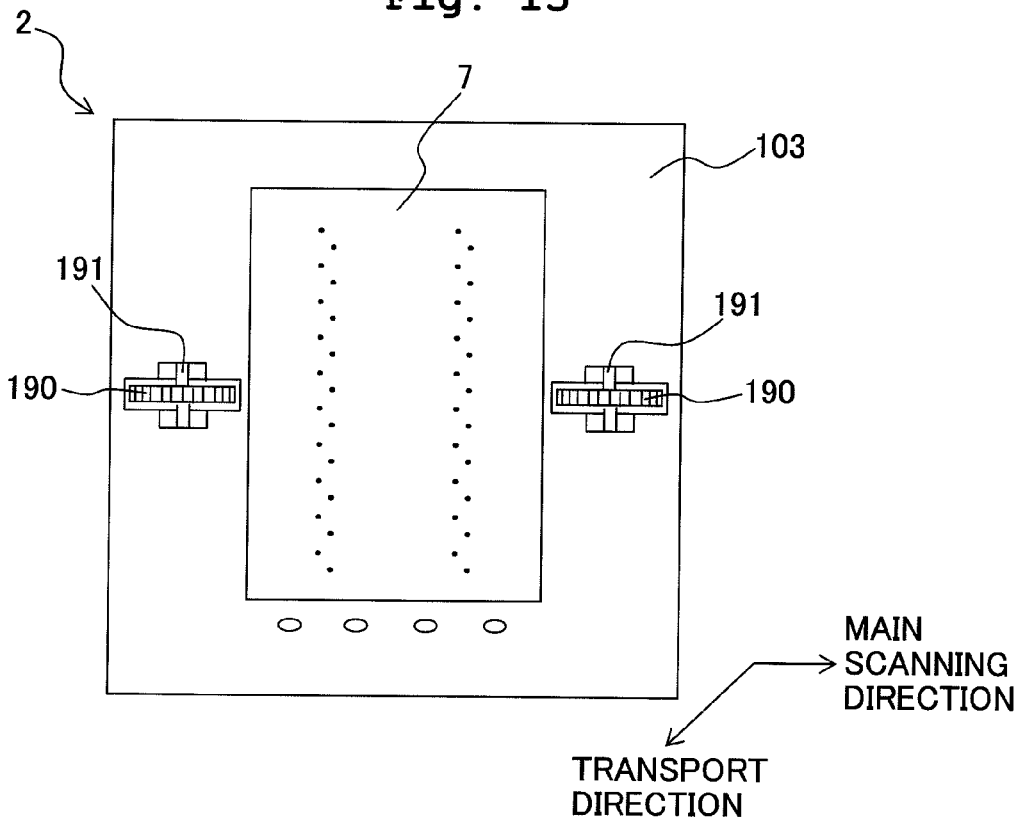
FIG. 15 is a plan view of a head unit of the serial head.

Here, as shown in FIG. 15, the ink-jet head 103 includes one head unit 2 and two spurs 190. A direction in which the nozzles 20 of the head unit 2 are extended coincides with the scanning direction of the carriage 104. The two spurs 190 are arranged respectively on both sides in the scanning direction of the head unit 2. Moreover, since rotating shafts 191 of the two spurs 190 are extended in a direction orthogonal to the scanning direction, when the head unit 2 scans in the scanning direction together with the carriage 104, the spurs 190 rotate with the scanning of the carriage 104. The recording paper P is pressed in a direction away from the head unit 102 by the spurs 190. Accordingly, it is possible to suppress the curling of the recording paper P which occurs due to the permeating of the ink jetted from the head unit 2 into the recording paper P. Since the two spurs 190 are arranged on two sides in the scanning direction sandwiching an area (printing area) of the ink jetting surface 7 of the head unit 2, in which the nozzles are formed, it is possible to press the recording paper P at a position sandwiching the area going to be subjected to printing. Therefore, it is possible to suppress the curling of the recording paper P in the scanning direction of the area going to be subjected to printing, and to improve a printing quality.

The two spurs 190 are not restricted to be arranged on two sides in the scanning direction of the head unit 2. As far as the two spurs 190 are arranged to sandwich the printing area of the head unit 2, it is possible to arrange the two spurs 190 arbitrarily. Here, sandwiching the printing area of the head unit 2 means that line connecting the two spurs 190 intersects with the printing area of the head unit 2. Moreover, in a case of an ink-jet head including only one head unit 2, it is not restricted to a serial ink-jet head, and may be a line ink-jet head. Furthermore, it is also possible to use (combine) a plurality of serial ink-jet heads to form the ink-jet head including the plurality of head units as described in the above embodiment. In that case, when the rotating shafts of the spurs are arranged to be perpendicular to the scanning direction in which the serial ink-jet heads are scanned, it is possible to rotate the spurs with the scanning of a carriage. Even in this case, it is possible to use various mechanisms showed in the embodiment described above. For instance, as a pressing mechanism, it is possible to provide an air blowing mechanism as described above, replacing the spurs. Moreover, as described above, when a liquid repellent area and recesses etc. are provided around the pressing mechanisms such as spurs, it is possible to inhibit the ink from reaching the pressing mechanisms.

The embodiment is an example in which the present invention is applied to an ink-jet printer which records an image etc. by jetting an ink on to a recording paper. However, an application of the present invention is not restricted to this. In other words, the present invention is applicable to various liquid droplet jetting apparatuses which jet liquids of various types other than ink, according to the application.

What is claimed is:

1. A liquid droplet jetting apparatus which jets liquid droplets of a liquid onto a sheet-shaped object, comprising:

a plurality of head units having liquid droplet jetting surfaces, respectively, in each of which a row of nozzles aligned in one direction is formed, the head units being arranged in a transport direction of the object intersecting the one direction;

a transporting mechanism which transports the object in the transport direction to a position at which the object faces the liquid droplet jetting surfaces of the plurality of head units; and a pressing mechanism which presses the object transported by the transporting mechanism, wherein two head units, among the plurality of head units, adjacent in the transport direction are arranged to be shifted in the one direction, and the pressing mechanism is arranged so as to be aligned in the one direction with one of the two adjacent head units, and to overlap with the other of the two adjacent head units in the transport direction, wherein the pressing mechanism overlaps with the transporting mechanism in a direction perpendicular to the liquid droplet jetting surfaces.

2. The liquid droplet jetting apparatus according to claim 1, wherein the pressing mechanism is formed as a plurality of pressing mechanisms, and the plurality of head units and the plurality of pressing mechanisms are arranged alternately in the one direction.

3. The liquid droplet jetting apparatus according to claim 1, wherein the pressing mechanism is a spur which rotates while making a contact with the object.

4. The liquid droplet jetting apparatus according to claim 1, wherein the pressing mechanism is an air blowing mechanism which presses the object by blowing air onto the object.

5. The liquid droplet jetting apparatus according to claim 1, further comprising a supporting member which supports the plurality of head units, wherein the pressing mechanism is provided on the supporting member.

6. The liquid droplet jetting apparatus according to claim 1, further comprising a wiper which wipes off the liquid adhered to the liquid droplet jetting surfaces by moving relative to the liquid droplet jetting surface in a predetermined wiping direction, while the wiper makes contact with the liquid droplet jetting surfaces of the head units; and liquid holding mechanisms which are arranged, on the liquid droplet jetting surfaces of the head units at a downstream side of the wiping direction, respectively, and which hold the liquid wiped off by the wiper from the liquid droplet jetting surfaces.

7. The liquid droplet jetting apparatus according to claim 1, wherein the pressing mechanism is formed as a plurality of pressing mechanisms, and the pressing mechanisms are arranged to be more densely at an upstream side in the transport direction than at a downstream side in the transport direction.

8. The liquid droplet jetting apparatus according to claim 1, further comprising a support member configured to support the plurality of head units, and in which a facing surface facing the sheet-shaped object is defined, wherein the facing surface is substantially parallel to the liquid droplet jetting surface, an opening is formed in the facing surface, and the pressing mechanism is arranged in the opening.

9. The liquid droplet jetting apparatus according to claim 5, wherein an inhibiting mechanism which inhibits the liquid adhered to the liquid droplet jetting surface from reaching the pressing mechanism, is provided on the supporting member at an area around the pressing mechanism.

10. The liquid droplet jetting apparatus according to claim 8, wherein a recess is formed in an outer edge region of the opening.

11. The liquid droplet jetting apparatus according to claim 9, wherein the inhibiting mechanism is a recess formed in the supporting member to surround the pressing mechanism.

12. The liquid droplet jetting apparatus according to claim 9, wherein the inhibiting mechanism is a liquid repellent area formed on the supporting member to surround the pressing mechanism, and a liquid repellent property of the liquid repellent area is higher than a liquid repellent property of an area, of the supporting member, which is different from the liquid repellent area.

13. A liquid droplet jetting apparatus which jets liquid droplets of a liquid on a sheet-shaped object, comprising:

a head which includes a head unit having a liquid droplet jetting surface in which a plurality of nozzles is formed and a jetting area is defined by the plurality of nozzles, and two pressing mechanisms which are arranged to interpose the jetting area of the head unit therebetween, and which press the object; and a transporting mechanism which transports the object in a transport direction to a position at which the object faces the liquid droplet jetting surface of the head unit, wherein the two pressing mechanisms overlap with the transporting mechanism in a direction perpendicular to the liquid droplet, and wherein the nozzles form a nozzle row extended in a first direction, and each of the two pressing mechanisms are arranged on at least one side, of the head unit, in the first direction, and the first direction intercepts the transport direction.

14. The liquid droplet jetting apparatus according to claim 13, wherein the nozzles form a nozzle row extended in the first direction, and the two pressing mechanisms are arranged on both sides, of the head unit, in the first direction.

15. The liquid droplet jetting apparatus according to claim 13, further comprising a supporting member configured to support the plurality of head units, and in which a facing surface facing the sheet-shaped object is defined, wherein the facing surface is substantially parallel to the liquid droplet jetting surfaces, an opening is formed in the facing surface, and the pressing mechanism is arranged in the opening.

16. The liquid droplet jetting apparatus according to claim 14, further comprising a carriage to which the head is attached, and which reciprocates in a second direction intersecting the first direction.

17. The liquid droplet jetting apparatus according to claim 15, wherein a recess is formed in an outer edge region of the opening.

18. The liquid droplet jetting apparatus according to claim 16, wherein the first direction is orthogonal to the second direction, and the two pressing mechanisms are spurs each having a rotating shaft extended in the first direction.

* * * * *